United States Patent [19]

Wong

[11] Patent Number: 4,636,282

[45] Date of Patent: Jan. 13, 1987

[54] METHOD FOR ETCHING COPPER AND COMPOSITION USEFUL THEREIN

[75] Inventor: Kwee C. Wong, Orange County, Calif.

[73] Assignee: Great Lakes Chemical Corporation, West Lafayette, Ind.

[21] Appl. No.: 747,037

[22] Filed: Jun. 20, 1985

[51] Int. Cl.[4] ..... C23F 1/02; B44C 1/22; C03C 15/00; C03C 25/06

[52] U.S. Cl. ..... 156/659.1; 156/656; 156/666; 156/902; 252/79.2; 252/79.4

[58] Field of Search ..... 252/79.2, 79.4, 142; 156/666, 659.1, 656, 901, 902; 430/313, 318

[56] References Cited

U.S. PATENT DOCUMENTS

| | | | |
|---|---|---|---|
| 2,694,001 | 11/1954 | Hayes | 252/79.4 |
| 3,328,303 | 6/1967 | Mahnkopf et al. | 252/79.4 |
| 3,463,733 | 8/1969 | Achenbach | 252/79.4 |
| 3,668,131 | 6/1972 | Banush et al. | 252/79.4 |
| 3,801,512 | 4/1974 | Solenberger | 252/186 |
| 4,130,454 | 12/1978 | Dutkewych et al. | 156/659 |

*Primary Examiner*—William A. Powell

*Attorney, Agent, or Firm*—Senniger, Powers, Leavitt and Roedel

[57] ABSTRACT

A composition of matter comprising sulfuric acid and guanidine, aminoguanidine, or formylated aminoguanidine. The composition is useful in the preparation of sulfuric acid/hydrogen peroxide etching solutions and in methods for etching copper, most particularly in the manufacture of printed circuits.

29 Claims, 4 Drawing Figures

METHOD FOR ETCHING COPPER AND COMPOSITION USEFUL THEREIN

BACKGROUND OF THE INVENTION

This invention relates to the etching of copper, and more particularly to novel compositions and methods useful in the etching of copper most particularly for the preparation of printed circuit boards.

In the preparation of printed circuit boards copper foil is clad to a flat baseboard or substrate of high dielectric strength, commonly referred to as the "insulator". By subtractive techniques, copper is removed from the foil in a pattern complementary to the pattern of the circuit to be produced. According to common practice the copper foil is coated with a photoresist (or "etch resist") whose solubility or dispersibility in a developing solution is changed when the resist is struck by light or other electromagnetic energy. Positive working resists are initially impervious to the developing agent, but are rendered removable thereby upon exposure to light. Negative working resists are initially soluble but are rendered impervious by exposure to light or other electromagnetic energy.

In preparing a circuit board, the resist is applied over the foil. The photoresist layer is exposed to light through a photographic transparency or stencil having a pattern therein corresponding to the circuit to be printed. Thereafter, the photoresist is contacted by the developer and removed from the foil in a pattern complementary to the circuit configuration. The foil in this complementary pattern is then contacted with an etching solution for removal of copper.

Solutions commonly employed for etching copper are alkaline or ammoniacal solutions, copper chloride solutions or ferric chloride solutions. In recent years, however, there has been a shift toward the use of etching solutions which comprise mixtures of hydrogen peroxide and sulfuric acid. The advantages of the peroxide sulfuric acid system include competitively low cost, ease of use, and in situ recovery of copper from the used etching solution in the form of copper sulfate or copper metal. Moreover, the solution from which copper has been recovered can be regenerated by replenishment of the hydrogen peroxide therein. This procedure provides not only for recovery of valuable copper but minimizes the environmental burden otherwise arising from the disposition of used etching solution.

However, the productivity of the peroxide/sulfuric acid etching process is often limited, sometimes severely, by the exhaustion of hydrogen peroxide from the etching solution. Such exhaustion arises not only from consumption in the oxidation of copper, but also from decomposition of unstable hydrogen peroxide. In particular, it has been found that instability of hydrogen peroxide increases with the concentration of heavy metals such as copper, as a consequence of which the rate of exhaustion accelerates progressively with repeated use of the etching solution and buildup of the copper content thereof. Thus the etch rate tends to fall off drastically, requiring frequent regeneration of the etching solution to avoid severe loss of productivity.

In an effort to stabilize acid/peroxide etching solutions against hydrogen peroxide decomposition, various stabilizing agents have been proposed. Thus Solenberger et al., U.S. Pat. No. 3,801,512 describes an acid/-peroxide copper etching solution which contains a stabilizer such as an aryl sulfonic acid, N,N-lower alkyl aniline, sulfamic acid, sulfolane, sulfolene, di-normal lower alkyl sulfones, di-normal lower alkyl sulfoxides and the like. However, while such stabilizers are effective for retarding the decomposition of the hydrogen peroxide, they tend to impede the etch rate at a given hydrogen peroxide level. Moreover, where the etching bath is used repetitively in a commercial etching process, deterioration in the etching rate becomes progressive even in the presence of a stabilizer of the type used by Solenberger et al.

Dutkewych et al. Pat. No. 4,130,454 describes a copper etching solution comprising sulfuric acid, hydrogen peroxide, an alkyl or aryl sulfonic acid, and a sodium molybdate. The molybdenum compound serves as a co-oxidant which is said to coact synergistically with the hydrogen peroxide to exalt the etch rate.

Banush et al. Pat. No. 3,668,131 describes a peroxide/sulfuric acid etching system which uses a urea or thiourea additive to increase the capacity and rate of etching. According to the Banush et al. disclosure, solutions containing such additives as methylurea, ethylurea, p-chlorophenylurea, and the like, etch copper at high rates and with high capacity, and also exhibit good storage life without substantial deterioration over periods of 4 to 10 days after preparation or longer.

Achenbach Pat. No. 3,463,733 describes copper etching baths comprised of sulfuric acid, hydrogen peroxide, mercuric chloride, and a stabilizer for the hydrogen peroxide which may be selected from among urea, semicarbazide, biuret, barbituric acid, and dipropylbarbituric acid.

SUMMARY OF THE INVENTION

Among the several objects of the present invention may be noted the provision of an improved etching solution for the etching of copper; the provision of such a solution which is effective for use in the preparation of printed circuit boards; the provision of such a solution which etches copper at a relatively high rate; the provision of such a solution whose stability is substantially preserved after repeated usage and/or when containing a substantial proportion of copper ion; the provision of a concentrate which can be mixed with hydrogen peroxide to produce an etching solution for copper; the provision of a novel method for the preparation of an etching solution concentrate; and the provision of novel processes for the etching of copper, particularly in the prepartion of printed circuit boards.

Briefly, therefore, the present invention is directed to a composition of matter comprising an aqueous solution containing sulfuric acid and between about 0.004 and about 0.02 moles per mole sulfuric acid of an additive compound corresponding to the formula

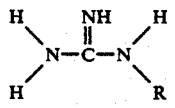

(I)

In this structure R is hydrogen or an amino group corresponding to the formula

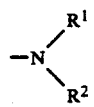

(II)

in which $R^1$ and $R^2$ are independently selected from among hydrogen and formyl.

The present invention is further directed to an aqueous composition adapted to be mixed with hydrogen peroxide to provide a solution for etching copper. The preparation of the composition comprises mixing sulfuric acid, phenol sulfonic acid or an alkali metal salt thereof in a proportion of between about 0.003 and about 0.05 moles per mole of sulfuric acid, aminoguanidine or an aminoguanidine salt in a proportion of between about 0.004 and about 0.02 moles per mole sulfuric acid, and formic acid in a proportion of between about 0.004 and about 0.02 moles per mole sulfuric acid. The sulfuric acid concentration in the resulting mixture is established at between about 40% and about 60% by weight.

The invention is further directed to a process for etching copper comprising contacting the surface of a copper article with an etching composition at a temperature of at least about 120° F. The etching composition comprises between about 8% and about 12% by weight sulfuric acid, at least about 0.5 moles hydrogen peroxide per mole sulfuric acid, and between about 0.004 and about 0.02 moles per mole sulfuric acid of an additive corresponding to formula I.

Further included in the invention is a process for preparing a printed circuit board. In accordance with such process a layer comprising a photoresist is applied to a surface of a copper sheet, the opposite surface of the copper sheet being adhered to a substrate element constituted of a material having a high dielectric strength. The photoresist layer is exposed to electromagnetic energy through a photographic transparency or stencil having a pattern therein corresponding to the desired configuration of a circuit to be produced on the substrate element, thereby altering the susceptibility to removal by a developing agent of the photoresist in the areas of said layer struck by electromagnetic energy, and producing in the layer a pattern of photoresist material which is complementary to the circuit pattern and which may be removed by the agent to expose portions of the copper sheet which are not part of the circuit. The developing agent is applied to the photoresist layer to remove the photoresist from the sheet in the aforesaid complementary pattern, and the copper exposed by removal of the resist is contacted with an etching solution, thereby dissolving and removing copper from the substrate in the complementary pattern. The etching solution comprises between about 8% and about 12% by weight sulfuric acid, at least about 0.5 moles hydrogen peroxide per mole sulfuric acid, and between about 0.004 and about 0.02 moles per mole sulfuric acid of an additive compound corresponding to formula I.

Further included in the invention is a process for preparing a composition adapted for use in the etching of copper. The process comprises mixing sulfuric acid, guanidine or guanidine derivative additive compound in a proportion of between about 0.004 and about 0.02 moles per mole sulfuric acid, and formic acid in a proportion between about 0.004 and about 0.02 moles per mole sulfuric acid, the additive compound comprising a carbamidine compound corresponding to formula I, or a salt of such carbamidine compound.

Other objects and features will be in part apparent and in part pointed out hereinafter.

BRIEF DESCRIPTION OF THE DRAWINGS

The drawings illustrate schematically the use of the etching process of the invention in the preparation of a printed circuit board.

Corresponding reference characters indicate corresponding parts in the several views of the drawings.

DESCRIPTION OF THE PREFERRED EMBODIMENT

Figure 1:
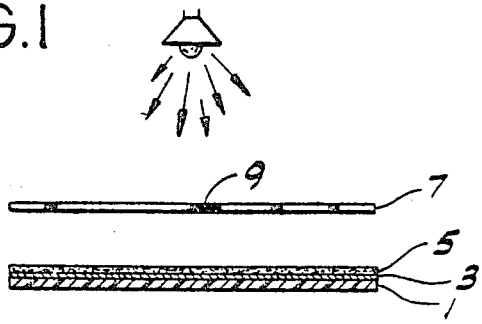
FIG. 1 is an elevational view of a copper sheet supported on a dielectric substrate and having a resist layer thereon which is being exposed through a photographic transparency or stencil.
Figure 2:
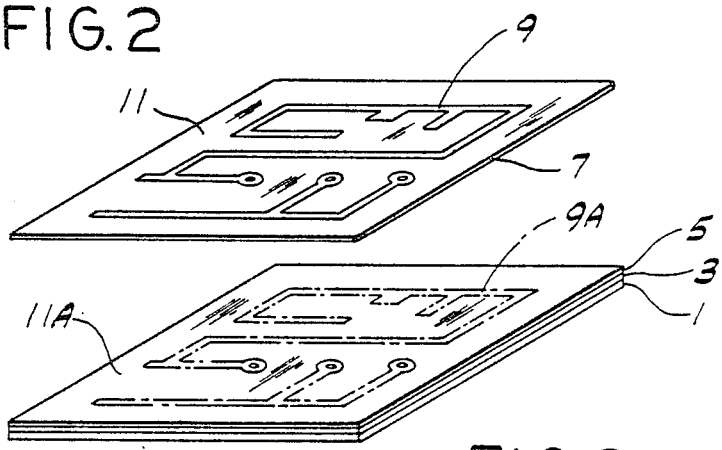
FIG. 2 is a perspective view showing the circuit pattern in the stencil, and the complementary pattern in a positive working photoresist layer which is rendered removable by a developer after exposure of the photoresist layer through the stencil.
Figure 3:
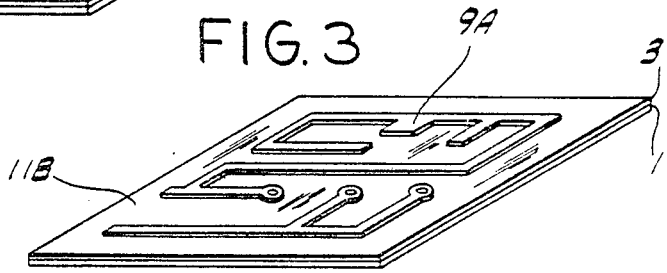
FIG. 3 shows the intermediate product obtained upon removal of the resist in the complementary pattern by application of a developing agent.
Figure 4:
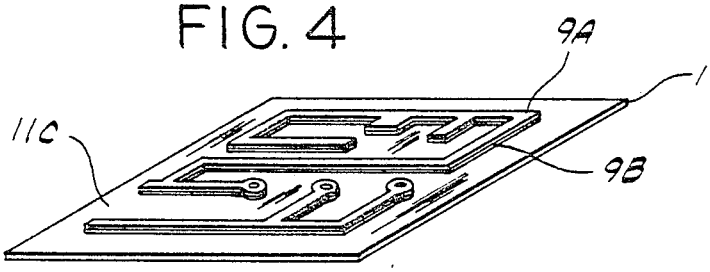
FIG. 4 illustrates the product obtained by use of the etching process of the invention for removal of copper from the sheet in the complementary pattern.

In accordance with the present invention, it has been discovered that both the initial etching rate achieved in the use of a sulfuric acid/hydrogen peroxide etching solution, and the stability of the solution, are enhanced by the incorporation into the solution of an additive compound comprising guanidine or certain guanidine derivatives. In particular, it has been found that the presence of such an additive is effective in preventing decomposition of hydrogen peroxide even after a substantial buildup of copper ion in the solution as a result of repetitive use thereof in the etching of copper. As a consequence, the novel compositions and etching processes of the invention provide a number of important advantages in such operations as the preparation of printed circuit boards. Because of the enhancement of initial etching rate and stabilization of hydrogen peroxide, a high sustained etching rate and high productivity are achieved. Because of the tolerance of the etching solutions for high concentrations of copper ions without significant deterioration of etching rate, the etching solution can be used repetitively in copper etching until the copper ion concentration reaches a level at which copper salt may be recovered by crystallization, or copper metal recovered by electrolytic reduction. Moreover, by such removal of copper and replenishment of hydrogen peroxide, the etching solution can be used almost indefinitely, thereby minimizing manufacturing costs and reducing the burden on the environment which may otherwise arise from the disposal of spent etching solution.

It has further been discovered that the additive compound used in the compositions and processes of the invention coacts synergistically with certain of the stabilizing agents disclosed in the aforesaid Solenberger patent, most particularly phenol sulfonic acid, toluene sulfonic acid or xylene sulfonic acid. Thus, the combination of a guanidine or guanidine derivative additive compound and the aryl sultonic acid is highly effective in stabilizing the hydrogen peroxide content of the etching solution against decomposition, but without the adverse effect on initial etching rate that is ordinarily experienced when an aryl sulfonic acid or other sulfonyl or sulfoxide compound stabilizing agent is employed.

Generally, the additive compound used in the compositions and processes of the invention corresponds to the structural formula:

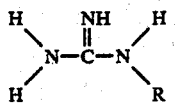

where R is hydrogen or an amino group corresponding to the formula:

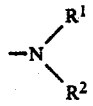

where $R^1$ and $R^2$ are independently selected from among hydrogen and formyl. Formylated aminoguanidine has been found to provide especially favorable stabilization and rate enhancement.

Essential components of the etching solution of the invention include sulfuric acid, hydrogen peroxide, and the guanidine or guanidine derivative additive compound. Preferably, the concentration of sulfuric acid in the etching solution is between about 8% and about 12% by weight. The hydrogen peroxide content of the etching solution is preferably maintained at least about 0.5, more preferably between about 1 and about 7, moles per mole of sulfuric acid. Most preferably the hydrogen peroxide content is between about 1.5 and about 6 moles per mole sulfuric acid. The proportion of the guanidine additive is preferably in the range of about 0.004 to about 0.02, more preferably between about 0.005 and about 0.010 moles per mole sulfuric acid.

As indicated above, it is preferred that the etching solution also contain an aryl sulfonic acid stabilizing agent selected from among phenol sulfonic acid, toluene sulfonic acid, xylene sulfonic acid, and alkali metal salts of such acids. Most preferably, the stabilizing agent is phenol sulfonic acid or its sodium salt. Preferably, the etching solution contains between about 0.003 and about 0.05 moles of the stabilizing agent per mole of sulfuric acid.

As noted, the etching solution of the invention preferably contains between about 8% and about 12% by weight sulfuric acid. In terms of weight proportions, the solution preferably contains between about 0.03% and about 0.015%, more preferably about 0.005% to about 0.010%, by weight quanidine or guanidine derivative, between about 0.05% and about 0.10%, more preferably about 0.06% to about 0.09%, by weight stabilizing agent, and between about 9% and about 13%, more preferably about 10% to about 12%, by weight hydrogen peroxide. When formic acid is used in the preparation of the etching bath, it is preferably incorporated in a proportion of between about 0.003% and about 0.015%, more preferably about 0.005% to about 0.010%, by weight.

As is in the case of other sulfuric acid/peroxide etching solutions known to the art, the etching solutions of the invention achieve maximum etching rate when the copper concentration reaches a moderate level. As described further below, the etching bath may routinely include residual copper as a result of the recycle of a solution from which copper has been recovered by crystallization of copper sulfate salt. The limit of copper solubility in the etching solution varies with the concentration of sulfate ion therein. Typically, however, after removal of copper sulfate by crystallization from a saturated bath, the etching solution contains between about 5 and about 8 ounces of copper ion per gallon.

Further in accordance with the invention, a novel concentrate is provided which is adapted to be mixed with hydrogen peroxide and water to produce the etching solution of the invention. The novel concentrate contains sulfuric acid, preferably in a concentration of between about 20% and about 80% by weight, more preferably about 40% to about 60% by weight, and the guanidine or guanidine derivative additive compound, generally in the same molar proportion to sulfuric acid as set forth hereinabove. Preferably, the concentrate further contains a stabilizing agent of the aforesaid type, again in a molar proportion to sulfuric acid in the range set forth above. Optionally, the concentrate may also contain a moderate proportion of copper ion in order to promote the intial etching rate using an etching solution prepared from the concentrate.

To prepare the novel concentrate of the invention, sulfuric acid is mixed with the additive compound, and preferably the stabilizing agent. If desired, copper sulfate may also be included in a proportion sufficient to provide between about 0.1 and about 1.0 parts by weight copper per part by weight sulfuric acid. Where aminoguanidine is used in preparing the concentrate, it is typically charged in the form of its carbonate or bicarbonate salt. Where aminoguanidine is used, it is further preferred that formic acid be included in the mixture, preferably in a proportion of between about 0.004 to about 0.02 moles per mole sulfuric acid. Although I do not wish to be bound to any particular theory, it is believed that the formic acid reacts with the aminoguanidine salt in the mixing process, thereby formylating the aminoguanidine in the R position of the above described generic formula.

In terms of weight proportions, the concentrate may contain between about 0.05% and about 0.9%, more preferably about 0.2 to about 0.4%, by weight of quanidine or guanidine derivative, and between about 0.7% and about 8%, more preferably about 2.5% to about 3.5% by weight stabilizing agent. When formic acid is used in the preparation of the concentrate, it is preferably incorporated in a proportion of between about 0.05% and about 0.9%, more preferably about 0.2 to about 0.4%, by weight.

The novel concentrate of the invention may be shipped, or stored essentially indefinitely, without deterioration of its properties. Whenever desired, the concentrate may be mixed with hydrogen peroxide to produce the novel etching solution of the invention. Depending on the strengths of the concentrate and hydrogen peroxide source, preparation of the etching solution of the invention may also involve mixing with deionized water to provide the desired acid concentration in the etching solution.

In accordance with the etching process of the invention, a copper article, such as a partially masked copper sheet, is contacted with the etching solution at a temperature of at least about 120° F., preferably 120° to 130° F. Copper metal contacted with the etching solution is oxidized and dissolved in the solution. In commercial applications, the etching solution typically comprises a bath which is used repetitively in the etching of a series of copper articles, as a result of which the hydrogen peroxide content of the bath is gradually depleted and the copper ion concentration in the bath progressively increases. Unlike conventional sulfuric acid/peroxide etching baths, the etching composition of the invention remains effective for high productivity etching even after the copper ion concentration has grown to a substantial level. Thus, a satisfactory etching rate is maintained simply by periodic replenishment of the hydrogen peroxide content of the bath so as to keep it above 0.5 moles, preferably within the range of about 1 to about 7 moles, per mole of sulfuric acid.

Once the copper concentration approaches saturation, copper may be removed and recovered by cooling the solution and crystallizating out copper sulfate. As noted above, the equilibrium concentration of copper ion varies with the strength of the sulfuric acid solution. For example, an 8% by weight sulfuric acid solution at 125° F. can contain up to about 10 oz. copper ion per gallon, a 10% acid solution can contain up to about 8 oz. copper ion per. gallon, and a 20% acid solution can contain up to about 5½ oz. copper ion per gallon. In recovering copper sulfate, the etching solution is cooled, preferably to about 60° to 65° F. to effect precipitation of copper sulfate crystals. The copper sulfate may then be separated and recovered by filtation or centrifugation.

Use of the process of the invention for the preparation of a printed circuit board is illustrated in the drawings. Thus, a photoresist layer 5 is applied over the surface of a copper foil or sheet 3, the copper sheet in turn being supported on a substrate ("insulator") board 1 constituted of a material of high dielectric strength. The photoresist layer is exposed to electromagnetic energy, typically actinic light, through a photographic film or stencil 7 having a pattern 9 therein corresponding to a circuit to be produced on the substrate. As illustrated in the drawings, the photoresist is positive working, so that the stencil or photographic film employed is opaque in the areas corresponding to those in which the circuit is to be established and transparent in the complementary area 11 corresponding to that from which the copper is to be removed to define the circuit, i.e., a positive photographic transparency may be used. On the other hand, if the photoresist is negative working, a photographic negative is typically used.

Exposure of the photoresist layer through the stencil or photographic transparency alters the susceptibility of the resist material to removal by a developing agent in the areas struck by electromagnetic energy. Typically, positive working resists are rendered soluble in a subtractive developing solution, and negative working resists are rendered insoluble in the developer, in the areas struck by actinic light. Thus, applying the developing agent to the exposed photoresist layer removes the resist from the copper sheet in a pattern 11A correspondonding to pattern 11 of the stencil, and thus complementary to the circuit to be established on the substrate. The resist remains intact in the pattern 9A corresponding to the circuit. Thereafter, copper of the complementary pattern 11B exposed by removal of the resist is contacted with the etching solution, thereby removing copper from the substrate and exposing the substrate in the complementary pattern 11C. The intact resist prevents etching of copper in the pattern 9B constituting the circuit to be produced.

As indicated above, use of the compositions and processes of the invention provides significant advantages in productivity, copper recovery, and pollution control for any process which involves the etching of copper, whether for production of printed circuit boards or otherwise. The novel concentrate of the invention affords special advantages since it can be shipped inexpensively, stored essentially indefinitely, and mixed at any time with hydrogen peroxide and water to provide an etching solution of high stability and high productivity etching capability.

The following examples illustrate the invention.

EXAMPLE 1

An etching solution was prepared in a glass beaker by charging to the beaker the following ingredients in the indicated proportions.

| | |
|---|---|
| Sulfuric Acid [60° Be'] | (1.5–1.8 moles) |
| Hydrogen peroxide | (1.8–1.9 moles) |
| Copper Sulfate Pentahydrate | (0.4–0.45 moles) |
| Phenolsulfonic acid sodium salt | (0.011–0.013 moles) |
| Deionized water | sufficient to make 1 liter of solution. |

The beaker containing the etching solution was placed in a water bath so as to maintain the temperature of the solution between 120° F. and 125° F. A one ounce double sided copper clad coupon (2"×2") was then immersed in the etching solution until all the copper was dissolved. With no agitation, the time for etching this coupon was 8 minutes.

EXAMPLE 2

An etching solution was prepared as described in Example 1, and to this solution was added a catalytic amount of aminoguanadine (about 0.02 gm) and formic acid ,(about 0.02 gm). A coupon of the type described in Example 1 was etched in this solution under the same conditions as those described in Example 1. In this instance, the time for etching the coupon was 6 minutes.

EXAMPLE 3

Another etching solution was prepared in the manner described in Example 1 and subjected to a stability test to determine the extent of loss of hydrogen peroxide from the solution at 24 hour intervals during a test period in which the bath was maintained in a constant temperature chamber at 120° F. The etching solution was contained in a beaker in the constant temperature chamber and the beaker was covered so as to minimize evaporation. The hydrogen peroxide concentration of the solution was determined at the 24-hour intervals by means of a redox titration.

EXAMPLE 4

Another etching solution was prepared in the manner described in Example 2 and subjected to the stability test described in Example 3. Data for the two stability tests are here set forth as Table 1.

$H_2O_2$ Concentration vs. time for fresh solution

| Time, h | Example 3 | Example 4 |
|---|---|---|
| 0 | 1.6152 mol/L | 1.5268 mol/L |
| 24 | 1.4886 mol/L | 1.3810 mol/L |
| 48 | 1.3619 mol/L | 1.2891 mol/L |
| 72 | 1.2266 mol/L | 1.1433 mol/L |
| 96 | 1.1277 mol/L | 1.0219 mol/L |

-continued

| Time, h | Example 3 | Example 4 |
|---|---|---|
| 120 | 1.0011 mol/L | 0.8987 mol/L |

EXAMPLE 5

Another sample etching solution was prepared in the manner described in Example 1 and subjected to a simulation of production etching. The sample solution was heated to and maintained at 120° F. on a water bath, and copper powder was intermittently sprinkled (2 g. at a time) into the solution. The rate and frequency of introduction of the copper powder was controlled so that the solution temperature did not rise above 128° F. as a result of the exotherm from the metal dissolution reaction. After the copper ion concentration in the solution had risen to 45 gpl, the etching solution was cooled to about 70° F., thereby causing precipitation of copper sulfate crystals, which were separated by filtration. The composition of the decanted etching solution was then readjusted by replenishment with hydrogen peroxide and a premixed concentrate of sulfuric acid, aryl sulfonic acid and aminoguanadine/formic acid. The sequence of copper dissolution, crystallization and etch solution replenishment was repeated through several cycles to produce an aged solution. Additional copper powder (120 g) was then dissolved in the aged solution and the solution subjected to both the etching test described in Example 1 and the stability test described in Example 5. In this instance it took about 10 minutes to etch the copper from a one ounce two-sided coupon.

EXAMPLE 6

Another sample etching solution was prepared in the manner described in Example 2 and this solution was subjected to the same processing and replenishment described in Example 5. After dissolution of 120 g copper in the aged solution, it took 5 minutes for a one ounce two-sided coupon to dissolve in the solution.

Set forth in Table 2 are the concentrations of hydrogen peroxide found in the aged solutions of Examples 5 and 6.

$H_2O_2$ vs. Time for "Aged" Solution

| Time, h | Example 5 | Example 6 |
|---|---|---|
| 0 | 1.7367 mol/L | 1.7263 mol/L |
| 2 | 1.6586 mol/L | 1.6881 mol/L |
| 4 | 1.6048 mol/L | 1.6343 mol/L |
| 6 | 1.5268 mol/L | 1.5853 mol/L |
| 10 | 1.3758 mol/L | 1.4886 mol/L |
| 24 | 0.3348 mol/L | 1.0704 mol/L |

From the above it may be seen that the guanidine derivative acts as a catalyst in the dissolution of copper, both in fresh and aged etching solutions, resulting in a substantial improvement in etch rate and productivity. The added amount of additive does not interfere with the stabilizing effect of an aryl sulfonic acid additive, but instead helps stabilize aged solutions resulting in a 50% improvement in stability.

In view of the above, it will be seen that the several objects of the invention are achieved and other advantageous results attained.

As various changes could be made in the above methods and products without departing from the scope of the invention, it is intended that all matter contained in the above description shall be interpreted as illustrative and not in a limiting sense.

WHAT IS CLAIMED IS:

1. A composition of matter comprising an aqueous solution containing sulfuric acid and between about 0.004 and about 0.02 moles per mole sulfuric acid of an additive compound corresponding to the formula:

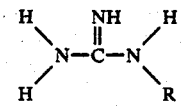

where R is selected from the group consisting of hydrogen and an amino group corresponding to the formula:

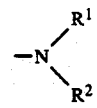

where $R^1$ and $R^2$ are independently selected from the group consisting of hydrogen and formyl.

2. A composition as set forth in claim 1 wherein R comprises an amino group.

3. A composition as set forth in claim 1 wherein one of $R^1$ and $R^2$ is hydrogen and the other of $R^1$ and $R^2$ is formyl.

4. A composition as set forth in claim 1 further comprising at least about 0.5 moles hydrogen peroxide per mole of sulfuric acid.

5. A composition as set forth in claim 1 further comprising between about 0.003 and about 0.05 moles per mole sulfuric acid of an aryl sulfonic acid stabilizing agent selected from the group consisting of phenol sulfonic acid, toluene sulfonic acid, xylene sulfonic acid, and alkali metal salts of said aryl sulfonic acids.

6. A composition as set forth in claim 5 wherein said stabilizing agent comprises phenol sulfonic acid or an alkali metal salt thereof.

7. A composition as set forth in claim 5 comprising an etching solution adapted for the etching of copper, said etching solution containing between about 8% and about 12% by weight sulfuric acid and further comprising at least about 0.5 moles hydrogen peroxide per mole sulfuric acid.

8. A composition as set forth in claim 7 further comprising between about 5 and about 8 ounces copper ion per gallon of solution.

9. A composition as set forth in claim 1 comprising a concentrate adapted to be mixed with hydrogen peroxide to produce an etching solution for the etching of copper, said concentrate composition containing between about 40% and about 60% sulfuric acid.

10. A composition as set forth in claim 9 further comprising between about 0.003 and about 0.05 moles per mole sulfuric acid of an aryl sulfonic acid stabilizing agent selected from the group consisting of phenol sulfonic acid, toluene sulfonic acid, xylene sulfonic acid, and alkali metal salts of said aryl sulfonic acids.

11. An aqueous composition adapted to be mixed with hydrogen peroxide to provide a solution for etching copper, the preparation of said composition comprising mixing sulfuric acid, phenol sulfonic acid or alkali metal salt thereof in a proportion of between about 0.003 and about 0.05 moles per mole of sulfuric acid, aminoquanidine or an aminoguanidine in a proportion of between about 0.004 and about 0.02 moles per mole sulfuric acid, and formic acid in a proportion of between about 0.004 and about 0.02 moles per mole sulfuric acid, the sulfuric acid concentration in the resulting mixture being between about 40% and about 60% by weight.

12. A process for etching copper, comprising contacting the surface of a copper article with an etching composition at a temperature of at least about 120° F., said etching composition comprising between about 8% and about 12% by weight sulfuric acid, at least about 0.5 moles hydrogen peroxide per mole sulfuric acid, and between about 0.004 and about 0.02 moles per mole sulfuric acid of an additive corresponding to the formula

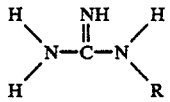

where R is selected from a group consisting of hydrogen and an amino group corresponding to the formula:

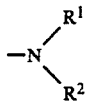

where $R^1$ and $R^2$ are independently selected from the group consisting of hydrogen and formyl.

13. A process as set forth in claim 12 wherein R comprises an amino group.

14. A process as set forth in claim 13 wherein one of $R^1$ and $R^2$ is hydrogen and the other of $R^1$ and $R^2$ is formyl.

15. A process as set forth in claim 12 wherein said etching solution further comprises between about 0.003 and about 0.05 moles per mole sulfuric acid of an aryl sulfonic acid stabilizing agent selected from a group consisting of phenol sulfonic acid, toluene sulfonic acid, xylene sulfonic acid, and alkali metal salts of said aryl sulfonic acids.

16. A process as set forth in claim 15 wherein said stabilizing agent comprises phenolsulfonic acid or an alkali metal salt thereof.

17. A process as set forth in claim 12 wherein said etching solution further comprises between about 5 and about 8 ounces copper ion per gallon of solution.

18. A process for preparation of a printed circuit board comprising the steps of:

applying a layer comprising a photoresist over the surface of a copper sheet, the opposite surface of said copper sheet being adhered to a substrate element constituted of a material having a high dielectric strength;

exposing said photoresist layer to electromagnetic energy through a photographic transparency or stencil having a pattern therein corresponding to the desired configuration of a circuit to be produced on said substrate element, thereby altering the susceptibility to removal by a developing agent of the photoresist of said layer in the areas thereof struck by electromagnetic energy and producing in said layer a pattern of photoresist material which is complementary to said circuit pattern and which may be removed by said developing agent to expose portions of said copper sheet which are not part of said circuit;

applying said developing agent to said resist layer to remove said resist from said sheet in said complementary pattern; and contacting with an etching solution the copper exposed by the removal of said photoresist, thereby dissolving and removing copper from said substrate in said complementary pattern, said etching solution comprising between about 8% and about 12% by weight sulfuric acid, at least about 0.5 moles hydrogen peroxide per mole of sulfuric acid, and between about 0.004 and about 0.02 moles per mole sulfuric acid of an additive compound corresponding to the formula:

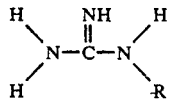

where R is selected from a group consisting of hydrogen and an amino group corresponding to the formula:

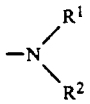

where $R^1$ and $R^2$ are independently selected from the group consisting of hydrogen and formyl.

19. A process as set forth in claim 18 wherein R comprises an amino group.

20. A process as set forth in claim 19 wherein one of $R^1$ and $R^2$ is hydrogen and the other of $R^1$ and $R^2$ is formyl.

21. A process as set forth in claim 18 wherein said etching solution further comprises between about 0.003 and about 0.05 moles per mole sulfuric acid of an aryl sulfonic acid stabilizing agent selected from a group consisting of phenol sulfonic acid, toluene sulfonic acid, xylene sulfonic acid, and alkali metal salts of said aryl sulfonic acids.

22. A process as set forth in claim 21 wherein said stabilizing agent comprises phenolsulfonic acid or an alkali metal salt thereof.

23. A process as set forth in claim 18 wherein said etching solution further comprises between about 5 and about 8 ounces copper ion per gallon of solution.

24. A process as set forth in claim 23 wherein said etching solution is used repetitively for etching copper from the copper sheets on a series of said substrates, thereby progressively increasing the copper ion content in said solution, said process further comprising the steps of cooling said solution to cause crystallization of copper sulfate, and separating the copper sulfate precipitate from the resultant slurry.

25. A process for preparing a composition adapted for use in the etching of copper, said process comprising mixing sulfuric acid, a guanidine or guanidine derivative additive compound in a proportion of between about 0.004 and about 0.02 moles per mole sulfuric acid, and formic acid in a proportion of between about 0.004 and about 0.02 moles per mole sulfuric acid, said additive compound comprising a carbamidine compound or a salt of a carbamidine compound corresponding to the formula:

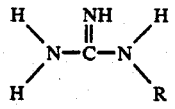

where R is selected from the group consisting of hydrogen and an amino group corresponding to the formula:

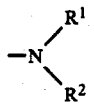

where $R^1$ and $R^2$ are independently selected from the group consisting of hydrogen and formyl.

26. A process as set forth in claim 25 wherein R comprises an amino group.

27. A process as set forth in claim 24 further comprising incorporating in said mixture an aryl sulfonic acid stabilizing agent selected from the group consisting of phenol sulfonic acid, toluene sulfonic acid, xylene sulfonic acid, and alkali metal salts of said aryl sulfonic acids.

28. A process as set forth in claim 27 wherein said stabilizing agent comprises phenol sulfonic acid or alkali metal salt thereof.

29. A process as set forth in claims 25 further comprising incorporating hydrogen peroxide into said mixture in a proportion of at leat about 0.5 moles per mole of sulfuric acid.

* * * * *

UNITED STATES PATENT AND TRADEMARK OFFICE

CERTIFICATE OF CORRECTION

PATENT NO. : 4,636,282

DATED : January 13, 1987

INVENTOR(S) : Kwee C. Wong

It is certified that error appears in the above—identified patent and that said Letters Patent is hereby corrected as shown below:

Column 1, line 8, "copper most" should read --copper, most--. Column 1, line 41, "in situ" should read --in situ--. Column 4, line 64, "aryl sultonic acid" should read --aryl sulfonic acid--. Column 5, line 30, "maintained at least about" should read --maintained at at least about--. Column 8, line 38, "acid, (about" should read --acid (about--. Column 11, claim 11, line 1, "aminoquanidine in a " should read --aminoguanidine salt in a--.

Signed and Sealed this

Twenty-second Day of November, 1988

*Attest:*

DONALD J. QUIGG

*Attesting Officer*

*Commissioner of Patents and Trademarks*